US006412233B1

(12) United States Patent
Jones

(10) Patent No.: US 6,412,233 B1
(45) Date of Patent: Jul. 2, 2002

(54) STRUCTURAL MEMBER SUPPORT AND POSITIONING SYSTEM

(76) Inventor: Terry V. Jones, 1804 Clay Ave., Terre Haute, IN (US) 47805

( * ) Notice: Subject to any disclaimer, the term of this patent is extended or adjusted under 35 U.S.C. 154(b) by 99 days.

(21) Appl. No.: 09/710,857

(22) Filed: Nov. 14, 2000

(51) Int. Cl.[7] ..... E04B 7/04

(52) U.S. Cl. ..... 52/92.2; 52/93.1; 52/290; 52/697; 52/677; 52/690; 52/696; 52/127.2; 52/300; 52/241; 52/93.2; 52/698

(58) Field of Search ..... 52/92.2, 93.1, 52/290, 697, 677, 690, 696, 127.2, 300, 241, 93.2, 698

(56) References Cited

U.S. PATENT DOCUMENTS

| | | | | |
|---|---|---|---|---|
| 1,803,723 A | * | 5/1931 | Murphy | 52/92.2 |
| 2,964,807 A | | 12/1960 | Kennedy | |
| 2,966,708 A | * | 1/1961 | Freeman, Jr. | 52/92.2 |
| 3,289,362 A | | 12/1966 | Whelan | |
| 3,360,892 A | * | 1/1968 | Rosso | 52/92.2 |
| 3,390,494 A | | 7/1968 | Chappie | |
| 3,421,270 A | | 1/1969 | Chaney | |
| 3,959,945 A | | 6/1976 | Allen | |
| 4,080,771 A | | 3/1978 | Weller | |
| 4,122,647 A | | 10/1978 | Kovar | |
| 4,246,736 A | | 1/1981 | Kovar et al. | |
| 4,361,999 A | | 12/1982 | Sidney | |
| 4,490,956 A | | 1/1985 | Palacio et al. | |
| 4,596,101 A | | 6/1986 | Brinker | |
| 4,637,195 A | | 1/1987 | Davis | |
| 4,669,235 A | | 6/1987 | Reinen | |
| 4,704,829 A | | 11/1987 | Baumker, Jr. | |
| 4,878,323 A | | 11/1989 | Nelson | |
| 5,412,920 A | | 5/1995 | Hess | |
| 5,606,837 A | | 3/1997 | Holizlander | |
| 5,884,448 A | | 3/1999 | Pellock | |

FOREIGN PATENT DOCUMENTS

| | | | | |
|---|---|---|---|---|
| DE | 32 13 358 A1 | * | 12/1981 | 52/92.2 |
| FR | 1.477.830 | * | 12/1966 | 52/92.2 |

* cited by examiner

*Primary Examiner*—Lanna Mai
*Assistant Examiner*—Dennis L. Dorsey
(74) *Attorney, Agent, or Firm*—Rosenberg, Klein & Lee

(57) ABSTRACT

A system (100) for positioning and securing structural members (20, 30) to supporting walls (10) of a building includes at least a pair of mounting devices (105) respectively mounted to a pair of longitudinally extended laterally spaced building supporting walls (10). Each mounting device (105) includes a base plate (110) having a plurality of pairs of fixing members (120) disposed in spaced longitudinal relationship. A space (118) between each of the pairs of fixing members (120) is provided for receiving the structural member (20, 30) therein. Each mounting device also includes a pair of second fixing members (122) disposed adjacent opposing ends of the base plate (110). Each of the fixing members (120 and 122) are formed by vertically directed C-shaped channel members. Each channel member has a central web portion (130) bounded on two vertically directed sides by a pair of flanges (132) expending in a longitudinal direction. The flanges provide lateral stability and torsion resistance to the support of corresponding structural members (20, 30).

14 Claims, 4 Drawing Sheets

STRUCTURAL MEMBER SUPPORT AND POSITIONING SYSTEM

BACKGROUND OF THE INVENTION

1. Field of the Invention

This invention directs itself to construction systems utilized for properly locating structural members which span between laterally spaced supporting walls. In particular, this invention directs itself to a system wherein at least a pair of mounting devices are mounted to substantially horizontal surface portions of a pair of longitudinally extended laterally spaced building supporting walls. Each of the pair of mounting devices is provided with a plurality of structural member receiving spaces disposed in correspondence with each other. Still further, the present invention includes mounting devices formed by a longitudinally extended base plate having a plurality of pairs of first fixing members respectively secured thereto. Each pair of first fixing members is disposed in opposing spaced parallel relationship to define respective structural member receiving spaces therebetween. More in particular, this invention pertains to mounting devices wherein the fixing members are formed by vertically directed C-shaped channel members, each having a web portion bounded on two vertically directed sides by a pair of flanges extending in a longitudinal direction.

2. Prior Art

Construction devices for positioning and securing structural members to supporting walls are well known in the art. The best prior art known to Applicant include U.S. Pat. Nos. 4,080,771; 4,669,235; 4,878,323; 3,390,494; 5,412,920; 2,964,807; 4,246,736; 4,361,999; 3,421,270; 3,289,362; 3,959,945; 4,490,956; 5,606,837; 5,884,448; 4,596,101; 4,637,195; 4,122,647; and, 4,704,829.

In some prior art systems, such as that disclosed by U.S. Pat. Nos. 4,080,771 and 4,669,235, there are provided truss aligning systems which become an integral part of the building structure when it is completed. In such systems, a flat metal member is provided which is mounted to the top plate of a building frame. The flat metal member has a plurality of pairs of upstanding flanges laterally spaced along the plate. Each of the pair of flanges are spaced apart one from another by a distance corresponding to the thickness of a roof truss or other structural member. Each of the flanges is provided with a plurality of apertures through which fasteners can be driven to secure the structural member thereto. However, such systems fail to disclose upstanding flanges formed by vertically directed C-shaped channels, wherein flange portions thereof extend in a longitudinal direction to rigidly support the web portion disposed between the flanges in a vertical orientation.

In other prior art systems, such as that disclosed by U.S. Pat. No. 5,412,920, an article for connecting laterally spaced beams is provided. Such structures engage the building members between respective clasping members. The two pair of opposing clasping members are interconnected by a spanning member, and reinforced by a web member extending therebetween. Such connecting devices fail to provide a web which is centrally disposed on the spanning portion and flanges, to maximize the resistance to deformation thereof.

SUMMARY OF THE INVENTION

A system for positioning and securing structural members to supporting walls of a building is provided. The system includes at least a pair of mounting devices respectively mounted to substantially horizontal surface portions of a pair of longitudinally extended laterally spaced building supporting walls. The pair of mounting devices each have a plurality of structural member receiving spaces formed thereon in correspondence with the other of the mounting devices. Each mounting device includes a longitudinally extended base plate having a plurality of longitudinally spaced first through holes formed therein through which fasteners pass for coupling the base plate to a respective building supporting wall. Each mounting device also includes a plurality of pairs of first fixing members respectively secured to the base plate. Each of the pair of first fixing members is disposed in opposing spaced parallel relationship to define a respective one of the receiving spaces therebetween for locating and securing a portion of a respective structural support member to the corresponding building supporting wall. Each of the first fixing members is formed by a vertically directed C-shaped channel member having a web portion bounded on two vertically directed sides by a pair of flanges extending in the longitudinal direction. Each building device also includes a pair of opposed second fixing members respectively secured to the base plate adjacent opposing ends thereof. Each of the second fixing members is formed by a vertically directed C-shaped channel member having a web portion bounded on two vertically directed sides by a pair of flanges extending in the longitudinal direction. One of the second fixing members is secured to the base plate at an endmost location and the other of the second fixing members is secured to the base plate at a location from which a pair of laterally spaced tabs extend.

DESCRIPTION OF THE PREFERRED EMBODIMENTS

Figures 1, 1A:
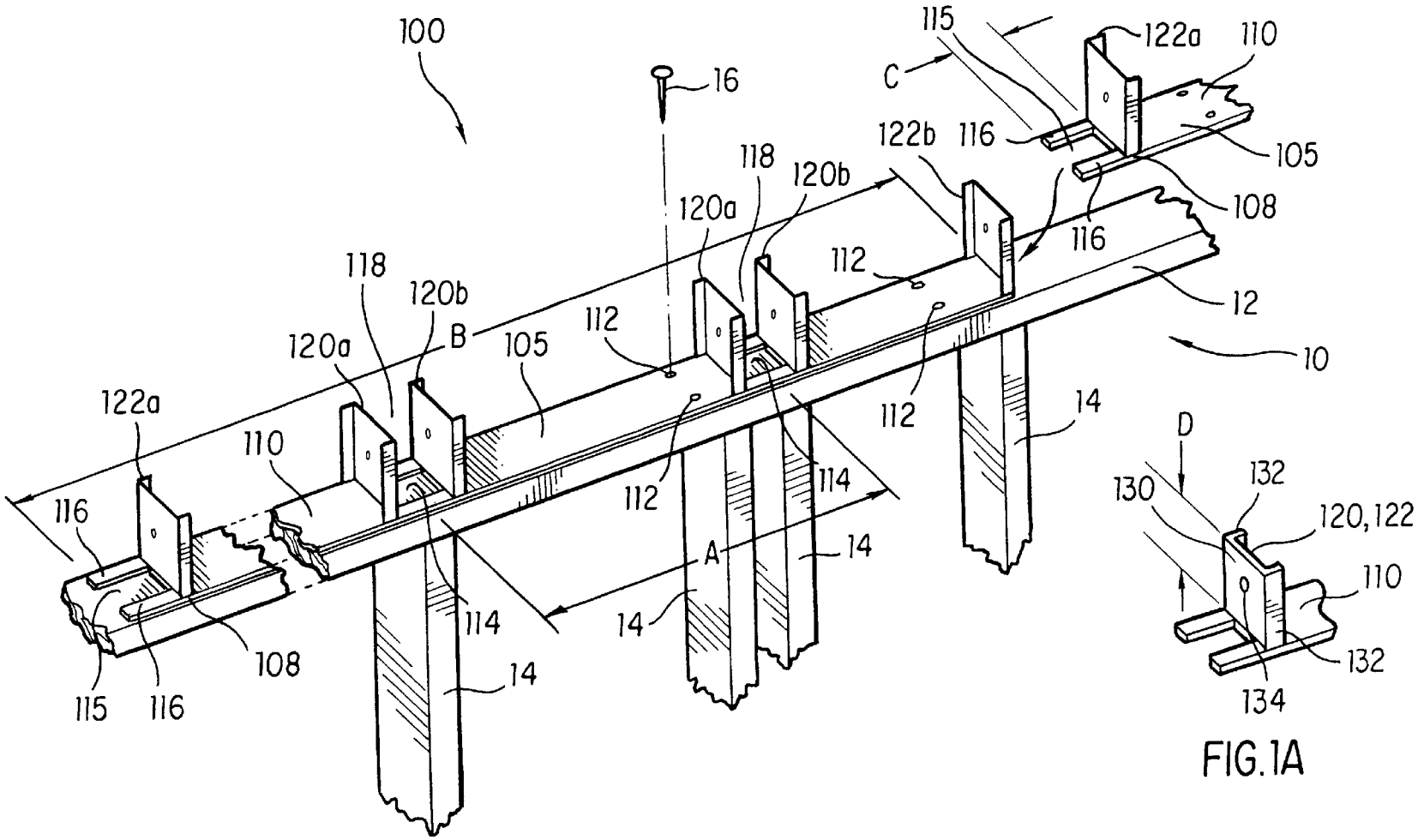
FIG. 1 is a perspective view of the present invention.
FIG. 1A is a cut-away perspective view of a fixing member of the present invention.

Referring now to FIGS. 1 through 6, there is shown structural member support and positioning system 100 for securing and properly locating structural members 20, 30 of a building during its construction. System 100 becomes a permanent part of a completed building, and facilitates the rapid setting of structural members such as roof trusses 20 or floor joists 30 between a pair of longitudinally extended laterally spaced building supporting walls 10 and provides improved strength of the resulting structure.

Referring more specifically to FIGS. 1, 1A, 3 and 4, there is shown structural member support and positioning system 100 wherein at least a pair of mounting devices 105 are respectively mounted to substantially horizontal surface portions of a pair of longitudinally extended laterally spaced building supporting walls 10. Each of the mounting devices 105 has a plurality of structural member receiving spaces 118 formed thereon in respective correspondence, one with the other, so that structural building members 20 can be positioned to extend between the parallel supporting walls 10 in properly spaced relationship. Thus, the mounting device 105 is secured to the header 12 that is supported by a plurality of studs 14 of a framed wall 10. The header 12 may be formed by one or more individual members, formed of wood, metal, laminated or composite materials, as permitted or required by local building codes, without departing from the spirit or scope of the inventive concepts disclosed herein. Each mounting device 105 is formed by a longitudinally extended base plate 110 having a plurality of through holes 112 formed therethrough. Through holes 112 provide a passage for fasteners 16 to secure the base plate 110 to the header 12. Fasteners 16 may be screws, nails or bolts, as appropriate to the material of header 12 and local building codes.

Each mounting device 105 further includes a plurality of pairs of fixing member 120 respectively secured to the base plate. Each pair of fixing members 120 are disposed in opposing spaced parallel relationship and between which is defined a respective one of the structural member receiving spaces 118. Each of the pair of fixing members 120 is formed by two vertically directed C-shaped channel members 120*a* and 120*b* disposed in opposing spaced relationship. Each C-shaped channel member 120*a*, 120*b* is formed by a web portion 130 bounded on two vertically directed sides by a pair of flanges 132 extending in the longitudinal direction. The flanges 132 of the C-shaped channel member 120*a* extend in an opposite direction from the flanges 132 of the C-shaped channel member 120*b* . Thus, the flanges 132 of each of the fixing members 120*a* and 120*b* are directed away from the corresponding structural member receiving space 118.

The use of C-shaped channel members to form the fixing members, with their oppositely directed flanges, is of critical importance to the structural integrity of the mounting device 105, and thereby the functionality of structural member support and positioning system 100. The oppositely directed flanges of each of the channel members 120*a*, 120*b* provides for an extremely rigid vertically directed structure to provide improved lateral stability and torsion resistance to the support of corresponding structural members 20. The rigid vertically directed structure also provides for the improved structural integrity of the mounting device 105, insuring that the vertical orientation of the channel members are maintained during shipment and storage.

Each mounting device 105 further includes opposed fixing members 122 respectively secured to the base plate 110 adjacent opposing longitudinal ends thereof. Like the fixing members 120, fixing members 122 are formed by vertically directed C-shaped channel members 122*a*, 122*b* having a web portion 130 bounded on two vertically directed sides by a pair of flanges 132 expending in a longitudinal direction. Although the fixing members 122*a* and 122*b* are disposed at opposing ends of base plate 110, the respective flanges 132 thereof extend in opposite directions. The use of C-shaped channel members to form the fixing members 122 is critically important to the structural integrity of mounting device 105, for the same reasons as discussed above with respect to fixing members 120. As will be explained further in following paragraphs, it is important that one of the fixing members 122*b* be located at an endmost location on the base plate 110 and the other of the fixing members 122*a* be secured to the based plate at a location 108 from which a pair of tabs 116 extend.

As can be seen in FIGS. 1 and 1A, each mounting device 105 has an overall longitudinal dimension B which is selected to be a standard length suitable for the construction industry. The longitudinal dimension B of each mounting device 105 may be 8, 12 or 16 feet, for example. The center-to-center distance A between adjacent structural member receiving spaces 118 is also selected to be a standard utilized in the construction industry, such as 16 inches or 24 inches. Obviously, the dimensions A and B can be other than those mentioned above without departing from the inventive concepts disclosed herein. The distance between the pairs of fixing members 120*a* and 120*b* is equal to the thickness of the structural member intended to be positioned therebetween. It is, however, important that the length C of the tabs 116 be equal to the thickness of the structural member being positioned between the fixing members 122*a* and 122*b*. In that way, the mounting devices 105 can be consecutively positioned on the header 12, one following another, while maintaining the appropriate center-to-center distance A between the structural member receiving spaces 118 of one mounting device 105 with those of an adjoining one. The height dimension D of the C-shaped channel members 120, 122 is also important to the stable support of structural members 20, 30. A stable base of support is obtained when the height dimension D is at least 25% of the height of the structural member being supported. In one working embodiment, the height dimension D is in the approximating range of 3–4 inches.

As a means of providing further increased lateral stability of such structural members as roof trusses 20 and torsion resistance, system 100 may include a plurality of bracing members 140 extending between adjacent trusses 20 and coupled thereto. As shown, truss 20 has a lower truss member 22 which is positioned in a respective receiving space 118 and secured therein through the use of fasteners 26 passed through through holes 134 in corresponding fixing members 120. Bracing members 140 extend between upper truss members 24 of adjacent trusses 20 and are secured thereto by fasteners 18 passing through corresponding through holes 150 of the respective bracing member 140. The use of bracing members 140 aids in stabilizing the trusses 20 against lateral rotational displacement during the construction process and improves the structural integrity of the structure in the completed building.

Figure 2:
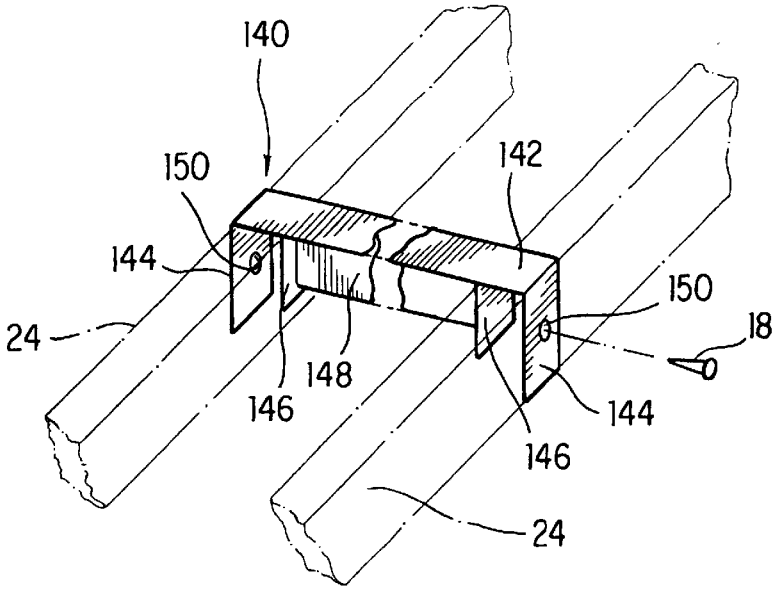
FIG. 2 is a perspective view of a bracing member of the present invention.
Figure 3:
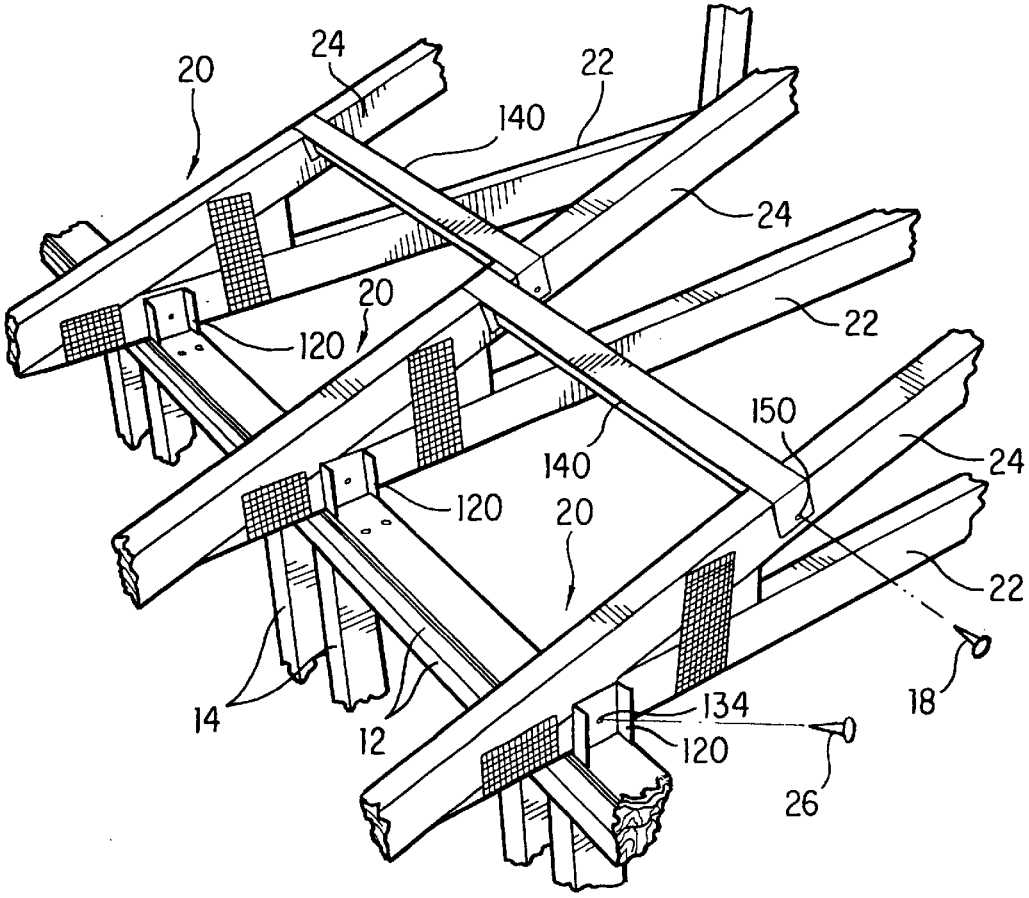
FIG. 3 is a perspective view illustrating an application of the present invention.
Figure 4:
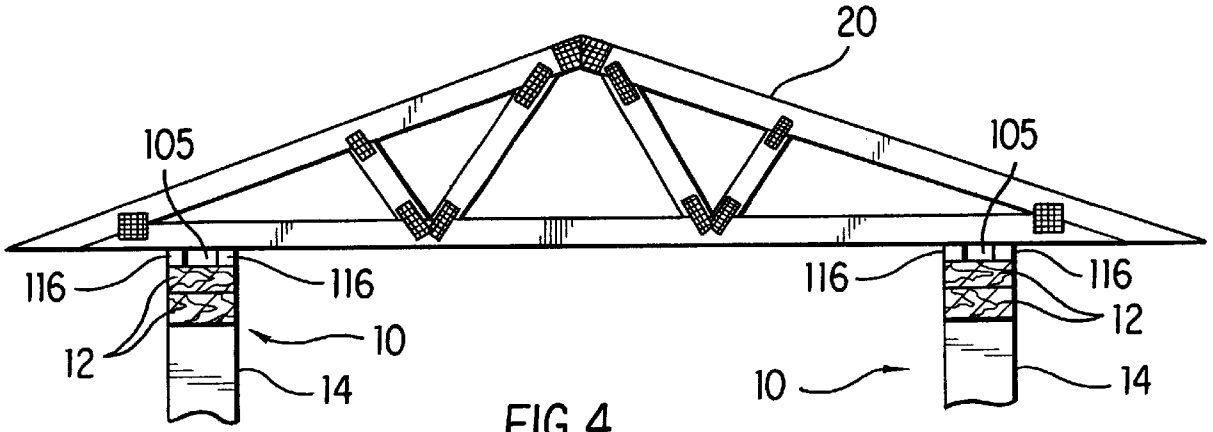
FIG. 4 is an elevation view of the application of the present invention.
Figure 5:
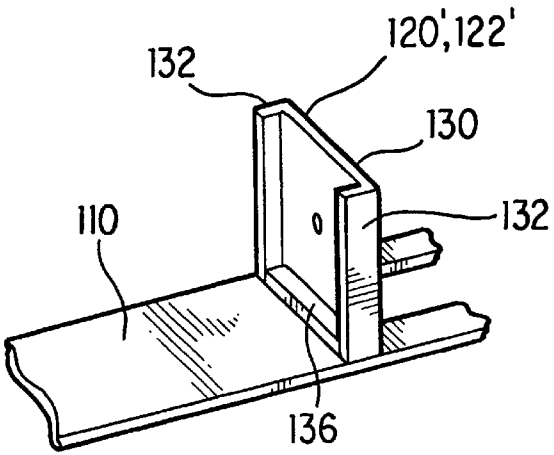
FIG. 5 is a cut-away perspective view of an alternate configuration of the fixing member of the present invention; and, FIG. 6 is a perspective view showing another application of the present invention.

As shown in FIG. 2, each bracing member 140 is formed by a longitudinally extended spanning member having a pair of flange members 144 respectively formed on opposing ends thereof. The spanning member 142 is dimensioned to position the pair of flange members 144 in contiguous contact with outer surfaces of the pair of adjacent truss members 24, or other structural building members. Each of the flange members 144 has an aperture 150 formed therethrough for passage of the fastener 18 to couple the bracing member 140 to the structural member 24. Fastener 18 may be any fastening type device, such as nails, screws, bolts or the like. It certainly would not be beyond the scope of system 100 to utilize adhesives for securing bracing members 140 to structural building members, securement of the structural building members within the receiving spaces 118, or securement of the mounting devices 105 to the horizontal surface of the supporting wall 10.

Each bracing member 140 also includes a pair of flange members 146 affixed to the spanning member 142 in longitudinally spaced relationship from a respective one of the pair of flange members 144. The flange members 146 being spaced from a corresponding flange member 144 a predetermined distance substantially equal to the thickness of the structural member 24, so as to position the flange members 146 contiguous an inner surface of the respective structural members 24. Each bracing member 140 includes a web member 148 centrally disposed on the spanning member and extending longitudinally between the pair of flange members 146. The web member 148 is affixed to both the pair of flanges 146 and the spanning member 142, as by welding or other conventional joining process. By laterally centering the web 148 with respect to the spanning member 142, maximum stiffening of both the spanning member 142 and the flanges 146 is achieved.

As is common in construction practice, such building structural members as roof trusses and floor joists are typically joined to supporting walls utilizing a fastening technique known as "toenailing" wherein a fastener is driven angularly through a side of the structural member to exit a bottom surface thereof for securement into the upper member of a supporting wall. Mounting devices 105 support the use of the "toenailing" technique in that the base plate 110 of each mounting device 105 includes a plurality of openings 114 formed therethrough in coincidence with each structural member receiving space 118 thereof, and an opening 115 disposed between the pair of tabs 116. Thus, between each pair of fixing members 120 there is disposed an opening 114 formed through the base plate 110 through which a fastener exiting a bottom surface of a corresponding structural member can pass for entry into the header 12. The opening 115 disposed between tabs 116 similarly serves the same function. Thus, a fastener 26 can be angularly passed through the opening 134 in a respective web portion 130 of a fixing member 120, 122 to secure the structural member 20 to the header 12, and thereby secure the structural member 20 to the mounting device 105.

The C-shaped channel members which form the fixing members 120, 122 are secured to the base plate 120 by welding. Where other fastening techniques are to be used, a structure such as that shown in FIG. 5 may be used. As shown, each fixing member 120', 122', in addition to the already described web portion 130 and flanges 132, includes a bottom flange 136 having a bottom surface thereof in contiguous contact with an upper surface of the base plate 110. The bottom flange 136 may then be secured to the base plate 110 through the use of fasteners, spot welding or other securement techniques. Other techniques for securing the C-shaped channels to the base plate 110 may also be utilized, such as extending portions of the flanges 132 through corresponding openings formed in the base plate and secured therein, for example.

Figure 6:
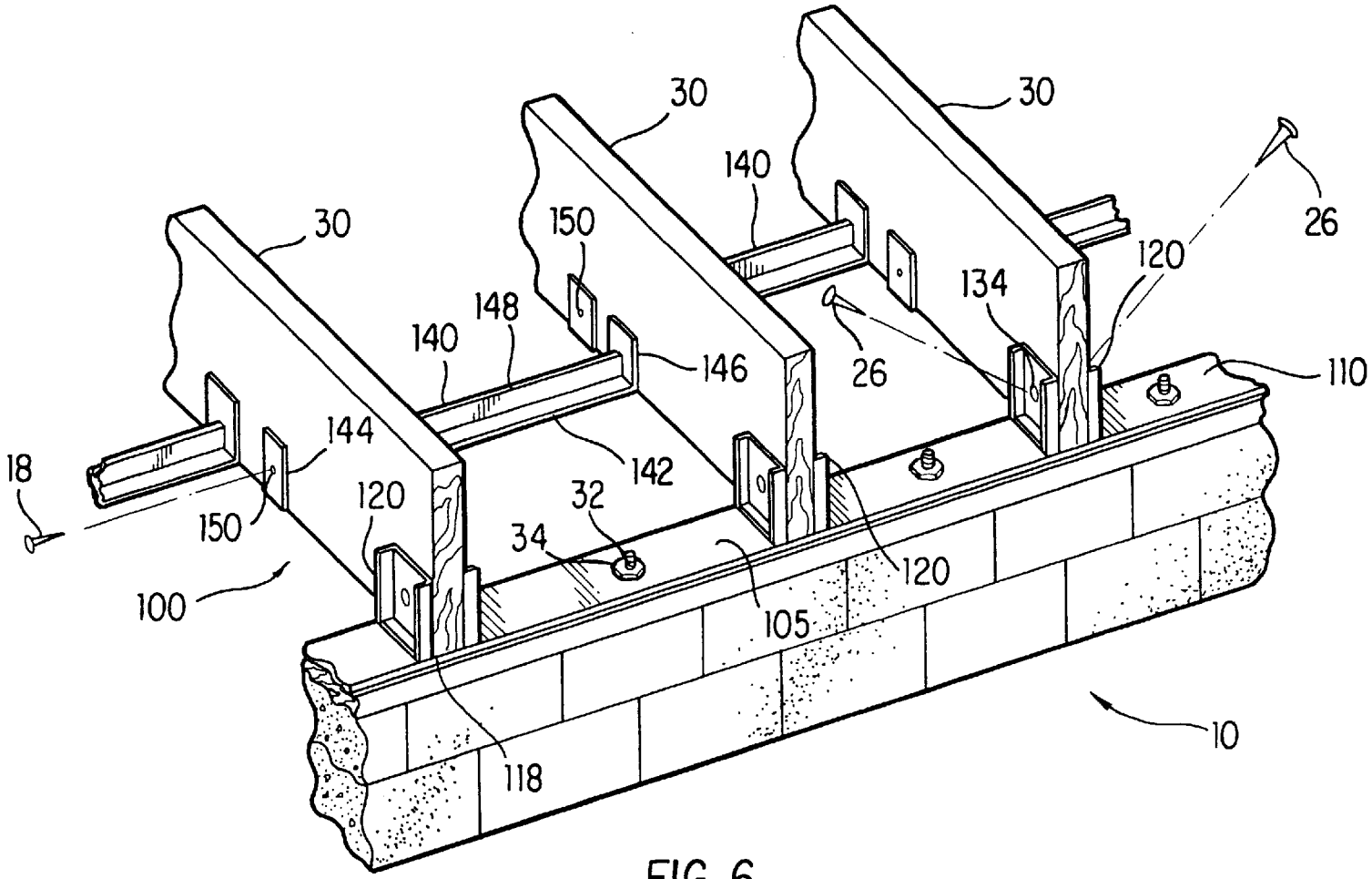

Referring now to FIG. 6, there is shown structural member support and positioning system 100 utilized for positioning and securing floor joists 30 to a supporting wall 10, which may be a foundation wall of a building. In this application, J-bolts 32 which have been set in the supporting wall 10 provide the means for securing the mounting device 105 thereto. The J-bolts 32 pass through corresponding through holes 112 wherein the threaded distal end thereof is engaged by a nut 34 which is tightened and holds the mounting device 105 in place. The floor joists 30 are positioned in the receiving spaces 118, between respective pairs of fixing members 120, and secured thereat by fasteners 26, in the same manner as when roof trusses are secured thereto. Where greater structural integrity is required, bracing members 140 may be utilized to interconnect laterally spaced trusses 30, with each truss being disposed between a respective pair of flanges 144 and 146 at opposing ends of the spanning member 142, with securement being provided by fasteners 18 being passed through openings 150 formed in respective flanges 144 at opposing ends of each bracing member 140.

Thus, it can be seen that system 100 provides a means for increasing the efficiency of building construction, providing a quick and easy method for accurately setting structural members, such as roof trusses and floor joists with proper spacing therebetween. System 100 further adds stability to the structure during the construction phase and increases the structural integrity of the completed building. A portion of the efficiency achieved by system 100 is a result of the use of C-shaped vertically directed channel members which form the fixing members 120 and 122. The C-shaped channels are highly resistance to being deformed, as would otherwise result were the members formed by simple planar structures, which would be likely to bend while being transported or stored. Thus, when the mounting devices 105 are utilized, the construction personnel need not take time out to realign the fixing members 120, 122, as such will be maintained in their proper vertical orientation by virtue of the flanges 132 which extend on the two vertically directed sides thereof. The positioning of the fixing members 122, with the member 122*a* being spaced from one end of the base plate 110, with a pair of tabs 116 extending therefrom, and the member 122*b* disposed at the opposing end, permits the mounting devices to be arranged consecutively while still maintaining the proper spacing between structural members mounted therein. Further, the height dimension of the each of the fixing members 120, 122 is in the approximating range of 3–4 inches, thereby providing support for a significant percentage of the structural member being set in the receiving space 118, typically being at least 25% of the height of the structural member.

Although this invention has been described in connection with specific forms and embodiments thereof, it will be appreciated that various modifications other than those discussed above my be resorted to without departing from the spirit or scope of the invention, for example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A system for positioning and securing structural members to supporting walls of a building comprising at least a pair of mounting devices respectively mounted to substantially horizontal surface portions of a pair of longitudinally extended laterally spaced building supporting walls, said pair of mounting devices each having a plurality of structural member receiving spaces formed thereon in correspondence with the other of said mounting devices, each of said mounting devices including:

(a) a longitudinally extended base plate having a plurality of longitudinally spaced first through holes formed therein through which fasteners pass for coupling said base plate to a respective building supporting wall;

(b) a plurality of pairs of first fixing members respectively secured to said base plate, each said pair of first fixing members being disposed in opposing spaced parallel relationship to define a respective one of said receiving spaces therebetween for locating and securing a portion of a respective structural support member to the corresponding building supporting wall, each of said first fixing members being formed by a vertically directed C-shaped channel member having a web portion bounded on two vertically directed sides by a pair of flanges extending in said longitudinal direction; and, (c) a pair of opposed second fixing members respectively secured to said base plate adjacent opposing ends thereof, each of said second fixing members being formed by a vertically directed C-shaped channel member having a web portion bounded on two vertically directed sides by a pair of flanges extending in said longitudinal direction, one of said second fixing members being secured to said base plate at an endmost location and the other of said second fixing members being secured to said base plate at a location from which a pair of laterally spaced tabs extend.

2. The system as recited in claim 1 where said pair of tabs extend longitudinally a distance substantially equal to a thickness dimension of a respective structural support member received thereon.

3. The system as recited in claim 2 where said web portion of each of said first and second fixing members has at least one second through hole formed therein and said base plate has a plurality of openings formed therethrough respectively disposed between each said pair of first fixing members to facilitate toe nailing of the structural members.

4. The system as recited in claim 3 further comprising a plurality bracing members respectively connecting adjacent pairs of the structural members at a location laterally spaced from each of said mounting devices.

5. The system as recited in claim 4 where each of said plurality bracing members includes:

(a) a longitudinally extended spanning member having a pair of first flange members respectively formed on opposing ends thereof, said spanning member being dimensioned to position said pair of first flange members in contiguous contact with outer surfaces of a pair of adjacent structural members, each of said first flange members having an aperture formed therein for passage of a fastener therethrough;

(b) a pair of second flange members affixed to said spanning member, said pair of second flange members each being longitudinally spaced from a respective one of said pair of first flange members to position said second flange members contiguous an inner surface of the pair of adjacent structural members; and, (c) a web member centrally disposed on said spanning member and extending longitudinally between said pair of second flange members, said web member being affixed to both said pair of second flanges and said spanning member.

6. The system as recited in claim 1 further comprising a plurality bracing members respectively connecting adjacent pairs of the structural members at a location laterally spaced from each of said mounting devices.

7. The system as recited in claim 6 where each of said plurality bracing members includes:

(a) a longitudinally extended spanning member having a pair of first flange members respectively formed on opposing ends thereof, said spanning member being dimensioned to position said pair of first flange members in contiguous contact with outer surfaces of a pair of adjacent structural members, each of said first flange members having an aperture formed therein for passage of a fastener therethrough;

(b) a pair of second flange members affixed to said spanning member, said pair of second flange members each being longitudinally spaced from a respective one of said pair of first flange members to position said second flange members contiguous an inner surface of the pair of adjacent structural members; and, (c) a web member centrally disposed on said spanning member and extending longitudinally between said pair of second flange members, said web member being affixed to both said pair of second flanges and said spanning member.

8. The system as recited in claim 1 where said web portion of each of said first and second fixing members has at least one second through hole formed therein and said base plate has a plurality of openings formed therethrough respectively disposed between each said pair of first fixing members to facilitate toe nailing of the structural members.

9. A system for positioning and securing structural members to supporting walls of a building comprising a plurality of mounting devices mounted to substantially horizontal surface portions of a pair of longitudinally extended laterally spaced building supporting walls, each of said plurality of mounting devices having a plurality of structural member first receiving spaces formed thereon and forming an additional structural member second receiving space at an interface between consecutively positioned pairs of said mounting devices, each of said mounting devices including:

(a) a longitudinally extended base plate having a plurality of longitudinally spaced first through holes formed therein through which fasteners pass for coupling said base plate to a respective building supporting wall;

(b) a plurality of pairs of first fixing members respectively secured to said base plate, each said pair of first fixing members being disposed in opposing spaced parallel relationship to define a respective one of said first receiving spaces therebetween for locating and securing a portion of a respective structural support member to the corresponding building supporting wall, each of said first fixing members being formed by a vertically directed C-shaped channel member having a web portion bounded on two vertically directed sides by a pair of flanges extending in said longitudinal direction; and, (c) a pair of opposed second fixing members respectively secured to said base plate adjacent opposing ends thereof, each of said second fixing members being formed by a vertically directed C-shaped channel member having a web portion bounded on two vertically directed sides by a pair of flanges extending in said longitudinal direction, a first of said second fixing members being secured to said base plate at an endmost location and a second of said second fixing members being secured to said base plate at a location from which a pair of laterally spaced tabs extend, said spaced tabs of one mounting device being disposed adjacent said first of said second fixing members of a consecutively positioned mounting device to define said second receiving space between said first of said second fixing members of one mounting device and said second of said second fixing members of the other mounting device.

10. The system as recited in claim 9 where said pair of tabs extend longitudinally a distance substantially equal to a thickness dimension of a respective structural support member received thereon.

11. The system as recited in claim 9 where said web portion of each of said first and second fixing members has at least one second through hole formed therein and said base plate has a plurality of openings formed therethrough respectively disposed between each said pair of first fixing members to facilitate toe nailing of the structural members.

12. The system as recited in claim 9 further comprising a plurality bracing members respectively connecting adjacent pairs of the structural members at a location laterally spaced from each of said mounting devices.

13. The system as recited in claim 12 where each of said plurality bracing members includes:

(a) a longitudinally extended spanning member having a pair of first flange members respectively formed on opposing ends thereof, said spanning member being dimensioned to position said pair of first flange members in contiguous contact with outer surfaces of a pair of adjacent structural members, each of said first flange members having an aperture formed therein for passage of a fastener therethrough;

(b) a pair of second flange members affixed to said spanning member, said pair of second flange members each being longitudinally spaced from a respective one of said pair of first flange members to position said second flange members contiguous an inner surface of the pair of adjacent structural members; and, (c) a web member centrally disposed on said spanning member and extending longitudinally between said pair of second flange members, said web member being affixed to both said pair of second flanges and said spanning member.

14. The system as recited in claim 9 where each of said C-shaped channel members forming both said first and second fixing members have a height dimension in the approximating range of 3–4 inches.

* * * * *